US006273068B1

(12) United States Patent
Joos et al.

(10) Patent No.: US 6,273,068 B1
(45) Date of Patent: Aug. 14, 2001

(54) FUEL SUPPLY SYSTEM FOR AN INTERNAL COMBUSTION ENGINE, PARTICULARLY OF A MOTOR VEHICLE

(75) Inventors: Klaus Joos, Walheim; Ralf Daeubel, Markgroeningen; Gerd Grass, Schwieberdingen; Ruediger Weiss, Moetzingen; Hansjoerg Bochum, Leinfelden, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/447,311

(22) Filed: Nov. 22, 1999

(30) Foreign Application Priority Data

Dec. 16, 1998 (DE) ..... 198 58 014

(51) Int. Cl.[7] ..... F02M 51/00
(52) U.S. Cl. ..... 123/491; 123/295
(58) Field of Search ..... 123/491, 480, 123/295, 478, 198 D

(56) References Cited

U.S. PATENT DOCUMENTS 4,444,173 * 4/1984 Yamato et al. ..... 123/491
5,408,975 * 4/1995 Blakeslee et al. ..... 123/491
5,492,101 * 2/1996 Saito et al. ..... 123/491
5,605,138 * 2/1997 Deichsel et al. ..... 123/491

* cited by examiner

*Primary Examiner*—Henry C. Yuen
*Assistant Examiner*—Mahmoud Gimie
(74) *Attorney, Agent, or Firm*—Kenyon & Kenyon

(57) ABSTRACT

A fuel supply system for an internal combustion engine, particularly of a motor vehicle, includes a control unit for determining a fuel quantity to be injected, the fuel quantity to be injected being initially increased during a start of the internal combustion engine and then being reduced again. The fuel supply system also includes a fuel injector for injecting the fuel quantity to be injected into a combustion chamber. It is checked by the control unit whether a combustion has taken place in the cylinder, and, if no combustion has taken place, the fuel quantity to be injected is not reduced, or is not reduced to the same extent as when a combustion has taken place.

8 Claims, 2 Drawing Sheets

FUEL SUPPLY SYSTEM FOR AN INTERNAL COMBUSTION ENGINE, PARTICULARLY OF A MOTOR VEHICLE

FIELD OF THE INVENTION

The present invention relates to a method for operating a fuel supply system for an internal combustion engine, particularly of a motor vehicle, in which a fuel quantity to be injected is determined by a control unit, the fuel quantity to be injected being initially increased during a start of the internal combustion engine and then being reduced again, and in which the fuel quantity to be injected is injected into a combustion chamber by a fuel injector. Furthermore, the present invention relates to a fuel supply system for an internal combustion engine, particularly of a motor vehicle, the fuel supply system having a control unit for determining a fuel quantity to be injected, it being possible to initially increase the fuel quantity to be injected during a start of the internal combustion engine and then to reduce it again, and having a fuel injector for injecting the fuel quantity to be injected into a combustion chamber.

BACKGROUND INFORMATION

Greater and greater demands are made on an internal combustion engine, for example, of a motor vehicle with regard to a reduction of the fuel consumption and the produced exhaust gases while, at the same time, desiring an increased power. For this purpose, modern internal combustion engines are provided with a fuel supply system in which the feeding of fuel into the combustion chamber of the internal combustion engine is controlled and/or regulated electronically, in particular, using a computer-aided control unit. In this context, it is possible to inject the fuel into an air intake tube of the internal combustion engine or directly into the combustion chamber of the internal combustion engine.

In the last-mentioned type, the "gasoline direct injection", it is required to inject the fuel into the combustion chamber under pressure. For this purpose, provision is made for an accumulator into which the fuel is pumped by a pump and put under a high pressure. From there, the fuel is injected directly into the combustion chambers of the internal combustion engine via fuel injectors. In a homogeneous operation, the injection begins during the induction period of the respective cylinder, whereas in a fuel-saving shift operation, the injection is carried out during the compression stroke.

In both indicated methods of operation, the fuel quantity to be injected directly into the combustion chambers of the internal combustion engine via the fuel injectors, such as, possibly, also the start of injection or the end of injection are determined in advance by the control unit as a function of a plurality of performance quantities of the internal combustion engine. Subsequently, the fuel injectors are controlled by the control unit according to the determined values.

To start the internal combustion engine, special starting processes are provided. Particularly at low outside temperatures, the fuel quantity to be injected must be increased in the first injection in comparison with an internal combustion engine at operating temperature. This is necessary in order that, during the start, a sufficient quantity of low-boiling gasoline constituents are present for an ignitable air/fuel mixture. The increased fuel quantity during the start is also required to build up a wall film of fuel on the inside walls of the cylinders. During the following injections, the indicated increased fuel quantity to be injected is reduced to the normal fuel quantity to be injected for the internal combustion engine at operating temperature again.

SUMMARY OF THE INVENTION

An object of the present invention is to provide a method for operating a fuel supply system as well as a fuel supply system for an internal combustion engine which enable an improved start of the internal combustion engine, particularly at low outside temperatures.

This objective is achieved according to the present invention in a method and a fuel supply system by checking whether a combustion has taken place in the cylinder, and, if no combustion has taken place, the fuel quantity to be injected is not reduced, or is not reduced to the same extent as when a combustion has taken place.

Consequently, a greater reduction of the fuel quantity to be injected in the next planned combustion in the respective cylinder is prevented exactly when no combustion has taken place. In this case, no significant heating of the cylinder or the internal combustion engine has occurred either. Therefore, the following planned combustion still requires an increased fuel quantity to make an ignitable air/fuel mixture available in the respective cylinder, and to build up a wall film in the combustion chamber of this cylinder.

This requirement is taken into account by the present invention. Thus, the present invention avoids a greater reduction of the fuel quantity to be injected in the absence of a combustion than it would be the case, for example, in a time-dependent reduction of the fuel quantity. Consequently, the present invention guarantees a secure starting operation even at low outside temperatures, and prevents, inter alia, misfiring during the start or even an unsuccessful starting operation.

In an advantageous embodiment of the present invention, the fuel quantity to be injected is reduced to a greater degree when a combustion has taken place. Only in the case that a combustion has actually occurred in one of the cylinders, the fuel quantity to be injected into this cylinder in the next planned combustion is markedly reduced. Because of the occurred combustion and the associated heating of the respective cylinder, in the next injection into this cylinder, it is no longer necessary to make a fuel quantity available which is increased to the same degree as before. Due to the heating, a smaller fuel quantity is sufficient to produce a combustion, and to form a sufficient wall film in the combustion chamber of the cylinder. This circumstance associated with the heating of the cylinder is taken into account by the present invention. The present invention checks specifically whether or not a combustion has actually taken place. Only in the first-mentioned case, the fuel quantity to be injected for the next combustion in this cylinder is considerably reduced.

In an advantageous embodiment of the present invention, the check as to whether a combustion has taken place is carried out as a function of one or more of the following performance quantities of the internal combustion engine:

- increase of temperature of the respective cylinder or of all cylinders;
- increase of pressure in the respective cylinder;
- increase of speed of the internal combustion engine;
- the lambda value of the exhaust gas of the respective cylinder or of all cylinders, which is yielded from a probe that evaluates the partial oxygen pressure;
- quantity of unburnt gasoline in the exhaust gas of the respective cylinder or of all cylinders;
- changes of the ignition voltage.

Using these performance quantities of the internal combustion engine, it is easy to determine whether or not a combustion has taken place in one of the cylinders. If, for example, the temperature of a specific cylinder rises after a firing of the spark plug of this cylinder, then, it can be concluded from this that this firing of the spark plug has caused an ignition of the air/fuel mixture in this cylinder, and thereby an actual combustion.

It is particularly advantageous to check whether a break-off criterion such as the reaching of a speed threshold is fulfilled, and, if the break-off criterion is fulfilled, to terminate the process. If, for example, a certain speed threshold is reached or exceeded, then this means that the starting operation is finished. In this case, the checking of the combustions in the individual cylinders can be ceased, and the fuel quantity to be injected can be injected into the combustion chambers of the internal combustion engine as a function of the normal determination by the control unit.

It is particularly advantageous to use the method on each of the cylinders of the internal combustion engine individually. In doing so, the start operation is controlled for each cylinder individually. It is checked for each cylinder individually whether a combustion has taken place in the respective cylinder, and the next injection into this respective cylinder is influenced as a function of this check.

Of particular advantage is the implementation of the method according to the present invention in the form of a control element which is designed for a control unit of an internal combustion engine, particularly of a motor vehicle. In this context, a program which is executable on a computing element, particularly on a microprocessor, and is suitable for carrying out the method according to the present invention, is stored on the control element. In this case, therefore, the present invention is implemented by a program stored on the control element so that this control element provided with the program represents the present invention in the same way as the method for whose performance the program is suitable. As a control element, especially an electrical storage medium can be used, for example, a read-only memory.

Further features, uses and advantages of the present invention ensue from the following description of exemplary embodiments of the present invention which are shown in the figures of the drawing. In this context, all described or represented features alone or in arbitrary combination constitute the subject matter of the present invention, independently of their composition in the patent claims, or the relating back of the patent claims, and independently of their formulation or representation in the description or in the drawing.

DETAILED DESCRIPTION

Figure 1:
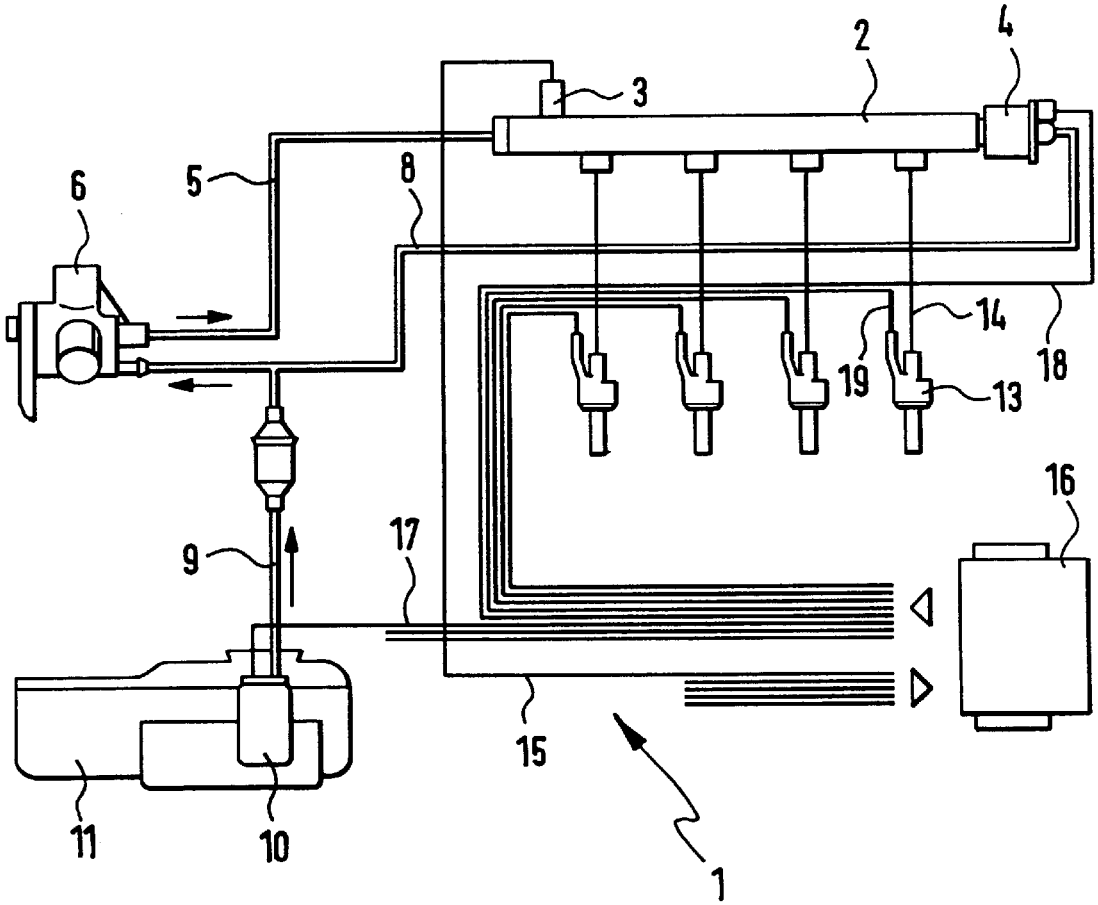
FIG. 1 shows a schematic representation of an exemplary embodiment of a fuel supply system according to the present invention.

FIG. 1 depicts a fuel supply system 1 which is designed for use in an internal combustion engine of a motor vehicle. Fuel supply system 1 is a "common-rail system" which is particularly used in an internal combustion engine having gasoline direct injection.

Fuel supply system 1 has an accumulator 2 which is provided with a pressure sensor 3 and a pressure-control valve 4. Accumulator 2 is connected to a high-pressure pump 6 via a pressure line 5. High-pressure pump 6 is connected to pressure-control valve 4 via a pressure line 8. Pressure-control valve 4 and, consequently, high-pressure pump 6 as well, are connected, via a pressure line 9 and a filter, to a fuel pump 10 which is suitable for drawing off fuel from a fuel tank 11.

Fuel supply system 1 has four fuel injectors 13 which are connected to accumulator 2 via pressure lines 14. Fuel injectors 13 are suitable for injecting fuel into the respective combustion chambers of the cylinders of the internal combustion engine.

Using a signal line 15, pressure sensor 3 is connected to a control unit 16, to which, moreover, a plurality of other signal lines are connected as input lines. Connected to control unit 16 are fuel pump 10 with the assistance of a signal line 17, as well as pressure-control valve 4 via a signal line 18. Furthermore, fuel injectors 13 are connected to control unit 16 via signal lines 19.

The fuel is pumped from fuel tank 11 to high-pressure pump 6 by fuel pump 10. With the assistance of high-pressure pump 6, a pressure is generated in accumulator 2, which is measured by pressure sensor 3, and can be adjusted to a desired value by actuating pressure-control valve 4 accordingly and/or controlling fuel pump 10. Then, the fuel is injected into the combustion chambers of the internal combustion engine via fuel injectors 13.

The fuel quantity to be injected for each combustion is determined in advance by control unit 16 as a function of a plurality of performance quantities of the internal combustion engine. Then, control unit 16 controls the respective fuel injector 13 into its open condition according to the determined fuel quantity.

To start the internal combustion engine, special starting processes are carried out by control unit 16. Particularly, at low outside temperatures, the fuel quantity to be injected must be increased during the start of the internal combustion engine. This is necessary in order that, during the start, a sufficient quantity of low-boiling gasoline constituents are present for an ignitable air/fuel mixture. The increased fuel quantity during the start is also required to build up a wall film of fuel on the inside walls of the cylinders. Moreover, at low outside temperatures, fuel losses must be compensated, for example, fuel which is transferred into the oil of the internal combustion engine.

The increase of the fuel quantity to be injected, which is carried out at the beginning of the start, is throttled back with the heating of the internal combustion engine. With each combustion, the corresponding combustion chamber heats up so that the fuel quantity to be injected can be reduced for the following combustions in this combustion chamber. After a certain period, the fuel quantity to be injected then reaches the normal fuel quantity which is valid for the internal combustion engine at operating temperature.

Thus, at the beginning of the starting operation, the fuel quantity to be injected is initially increased in each of the cylinders, starting from an initial value, to be subsequently reduced to more or less the normal initial value again during the ongoing start of the internal combustion engine.

Figure 2:
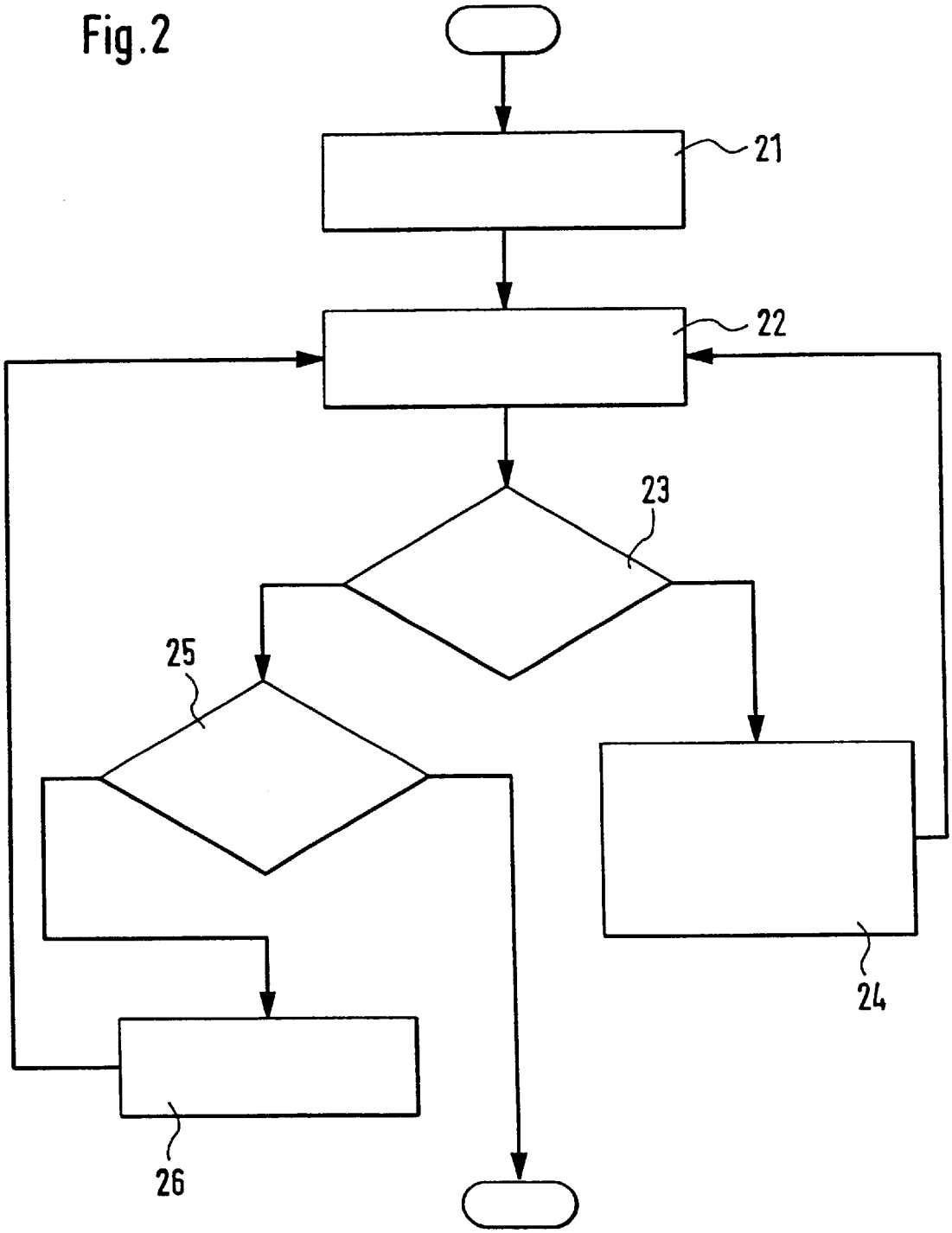
FIG. 2 shows a schematic block diagram of an exemplary embodiment of a method according to the present invention for operating the fuel supply system of FIG. 1.

Particularly for the transition from the initially increased fuel quantity to the normal fuel quantity, the following process, which is shown in FIG. 2, is carried out by control unit 16. In this context, the individual blocks of the process can be implemented in control unit 16, for example, as modules of a program or the like.

It is preferably assumed that the internal combustion engine is to be started at low outside temperatures, and that the internal combustion engine is not at normal running temperature.

In a step 21, control unit 16 determines for each cylinder of the internal combustion engine that starting quantity with which the starting operation of the internal combustion engine is to begin. This starting quantity depends, inter alia, on the outside temperature and, possibly, on other performance quantities of the internal combustion engine. Compared to the fuel quantity to be injected normally, this starting quantity is increased.

In accordance with step 22, this increased starting quantity is then injected into each cylinder of the internal combustion engine and ignited with the assistance of one spark plug, respectively, following the order predetermined for the cylinders. This represents the first combustion for each of the cylinders.

At this juncture, it is pointed out that the block diagram of FIG. 2 refers only to one of the cylinders of the internal combustion engine. Therefore, the consecutive numbering of the combustions is always referred to one of the cylinders, as well. Consequently, when, in the following, a second or next combustion is mentioned, then this refers always to one specific cylinder, and not to the sequence of all combustions in all cylinders of the internal combustion engine.

In a step 23, it is checked for the fuel quantity which has been injected into one of the cylinders and ignited whether this fuel quantity has actually burnt in the respective cylinder.

This check can be carried out as a function of one or more of the following performance quantities of the internal combustion engine:

increase of temperature of the respective cylinder or of all cylinders;

increase of pressure in the respective cylinder;

increase of speed of the internal combustion engine;

the lambda value of the exhaust gas of the respective cylinder or of all cylinders, which is yielded from a probe that evaluates the partial oxygen pressure;

quantity of unburnt gasoline in the exhaust gas of the respective cylinder or of all cylinders;

changes of the ignition voltage.

By relating the respective performance quantity to a point of time appertaining to the respective cylinder, it is possible, for example, to infer the rise of temperature of the respective cylinder, and, consequently, a combustion in this cylinder from a rise of temperature of all cylinders of the internal combustion engine. From an increase of the speed of the internal combustion engine, a contribution to the speed increase by the respective cylinder, and, consequently, a combustion in this cylinder can be inferred accordingly.

If, during the check of step 23, control unit 16 determines that no combustion has taken place in the respective cylinder, then this means that no heating of this cylinder has occurred. Therefore, no or only a comparatively slight reduction of the fuel quantity to be injected is carried out during the determination of the fuel quantity to be injected for the next combustion in this cylinder. The term "comparatively" refers to the greater reduction of the fuel quantity to be injected in response to an occurred combustion, the greater reduction still being explained in the following. In any case, the reduction of the fuel quantity to be injected is not carried out to the same extent as when a combustion has taken place.

In a step 24, this slightly reduced or equal fuel quantity to be injected is determined by control unit 16, and then, in a step 22, injected into the respective cylinder for the second, or in each case next combustion and ignited. Subsequently, the process is continued with step 23 as already described.

If, during the check of step 23, it is determined that a combustion has taken place in the respective cylinder, that, therefore, the injected fuel has burnt, and, consequently, the cylinder has heated up, then, it is checked in a step 25 whether a break-off criterion is already fulfilled.

This break-off criterion can be, for example, a speed threshold, and/or a specific number of actual combustions in the respective cylinder, and/or the exceeding of a specific intake pressure or exhaust back pressure, or the like. If, for example, the indicated speed threshold is exceeded, then this means that the combustion engine has started, and, consequently, that the starting process is finished.

If this break-off criterion is not fulfilled yet, if, for example, the internal combustion engine has not reached a sufficient speed yet, then the fuel quantity to be injected for the next planned combustion in the respective cylinder is reduced in a step 26. The reduction of the fuel quantity to be injected is significantly greater in the case that a combustion actually exists in the respective cylinder than in the already explained case when no combustion has taken place in the respective cylinder at all. This fuel quantity to be injected, which is determined by control unit 16 in step 26, is then, in step 22, injected into the respective cylinder for the next combustion and ignited. Then, the process is continued with step 23 as described.

If the break-off criterion of step 25 is fulfilled, then the process, and, consequently, the starting operation are finished.

What is claimed is:

1. A method for operating a fuel supply system for an internal combustion engine of a motor vehicle, comprising the steps of:

determining a fuel quantity to be injected;

initially increasing the fuel quantity to be injected during a start of the internal combustion engine and then reducing the fuel quantity to be injected;

injecting the fuel quantity to be injected into a combustion chamber of a cylinder of the engine by a fuel injector;

determining, at the start of the engine, whether a combustion has taken place in the cylinder, wherein, if the combustion has not taken place, the fuel quantity to be injected is not reduced or is reduced to a lesser extent than when the combustion has taken place.

2. The method according to claim 1, wherein, if the combustion has not taken place, the fuel quantity to be injected is reduced to a lesser extent than when the combustion has taken place.

3. The method according to claim 1, wherein the determination of whether the combustion has taken place is performed as a function of at least one of the following performance quantities of the internal combustion engine:

(a) an increase of a temperature of at least one cylinder;

(b) an increase of a pressure in at least one cylinder;

(c) an increase of a speed of the engine;

(d) a lambda value of an exhaust gas of at least one cylinder provided from a probe that evaluates a partial oxygen pressure;

(e) a quantity of unburnt gasoline in the exhaust gas of at least one cylinder; and (f) changes of an ignition voltage.

4. The method according to claim 1, further comprising the steps of:

checking whether a break-off criterion is fulfilled; and if the break-off criterion is fulfilled, terminating the steps of the method.

5. The method according to claim 4, wherein the break-off criterion includes a reaching of a speed threshold.

6. The method according to claim 1, wherein the steps are performed on each of the cylinders of the engine individually.

7. A read-only memory for a control unit of an internal combustion engine of a motor vehicle, the memory storing a program, which is executable on a microprocessor, for carrying out the following steps:

determining a fuel quantity to be injected;

initially increasing the fuel quantity to be injected during a start of the internal combustion engine and then reducing the fuel quantity to be injected;

injecting the fuel quantity to be injected into a combustion chamber of a cylinder of the engine by a fuel injector;

determining, at the start of the engine, whether a combustion has taken place in the cylinder, wherein, if the combustion has not taken place, the fuel quantity to be injected is not reduced or is reduced to a lesser extent than when the combustion has taken place.

8. A fuel supply system for an internal combustion engine of a motor vehicle, comprising:

a control unit for determining a fuel quantity to be injected, for initially increasing the fuel quantity to be injected during a start of the internal combustion engine and then reducing the fuel quantity to be injected, and for determining, at the start of the engine, whether a combustion has taken place in a cylinder of the engine; and a fuel injector for injecting the fuel quantity to be injected into a combustion chamber of the cylinder, wherein, if the combustion has not taken place, the fuel quantity to be injected is not reduced or is reduced to a lesser extent than when the combustion has taken place.

* * * * *